United States Patent [19]

Krishna et al.

[11] Patent Number: 4,997,545

[45] Date of Patent: Mar. 5, 1991

[54] METHOD FOR SELECTIVE ALTERATION OF FLUID CATALYTIC CRACKER YIELD STRUCTURES

[75] Inventors: Ashok S. Krishna, Concord, Calif.; Dennis C. Kowalczyk, Oakmont, Pa.

[73] Assignee: Chevron Research Company, San Francisco, Calif.

[21] Appl. No.: 792,721

[22] Filed: Dec. 6, 1985

[51] Int. Cl.[5] ..... C10G 11/02

[52] U.S. Cl. ..... 208/114

[58] Field of Search ..... 208/113, 120, 111, 114; 502/54

[56] References Cited

U.S. PATENT DOCUMENTS

| | | | |
|---|---|---|---|
| 3,404,086 | 10/1968 | Plank | 208/111 |
| 3,595,611 | 7/1971 | McDaniel et al. | 208/120 X |
| 3,644,200 | 2/1972 | Young | 208/120 |
| 4,432,890 | 2/1984 | Beck et al. | 208/120 X |
| 4,448,073 | 5/1984 | Shihabi | 208/120 X |
| 4,551,231 | 11/1985 | Kovach et al. | 208/120 |

*Primary Examiner*—Curtis R. Davis

[57] ABSTRACT

A method for selective alteration of yield structures in fluid catalytic cracking units toward more middle distillate (light catalytic gas oil) and less light distillate (gasoline) by the addition of basic nitrogen compounds.

10 Claims, 2 Drawing Sheets

EFFECT OF BASIC NITROGEN ON FCC LIGHT CATALYTIC GAS OIL YIELD

METHOD FOR SELECTIVE ALTERATION OF FLUID CATALYTIC CRACKER YIELD STRUCTURES

FIELD OF INVENTION

Figure 1:
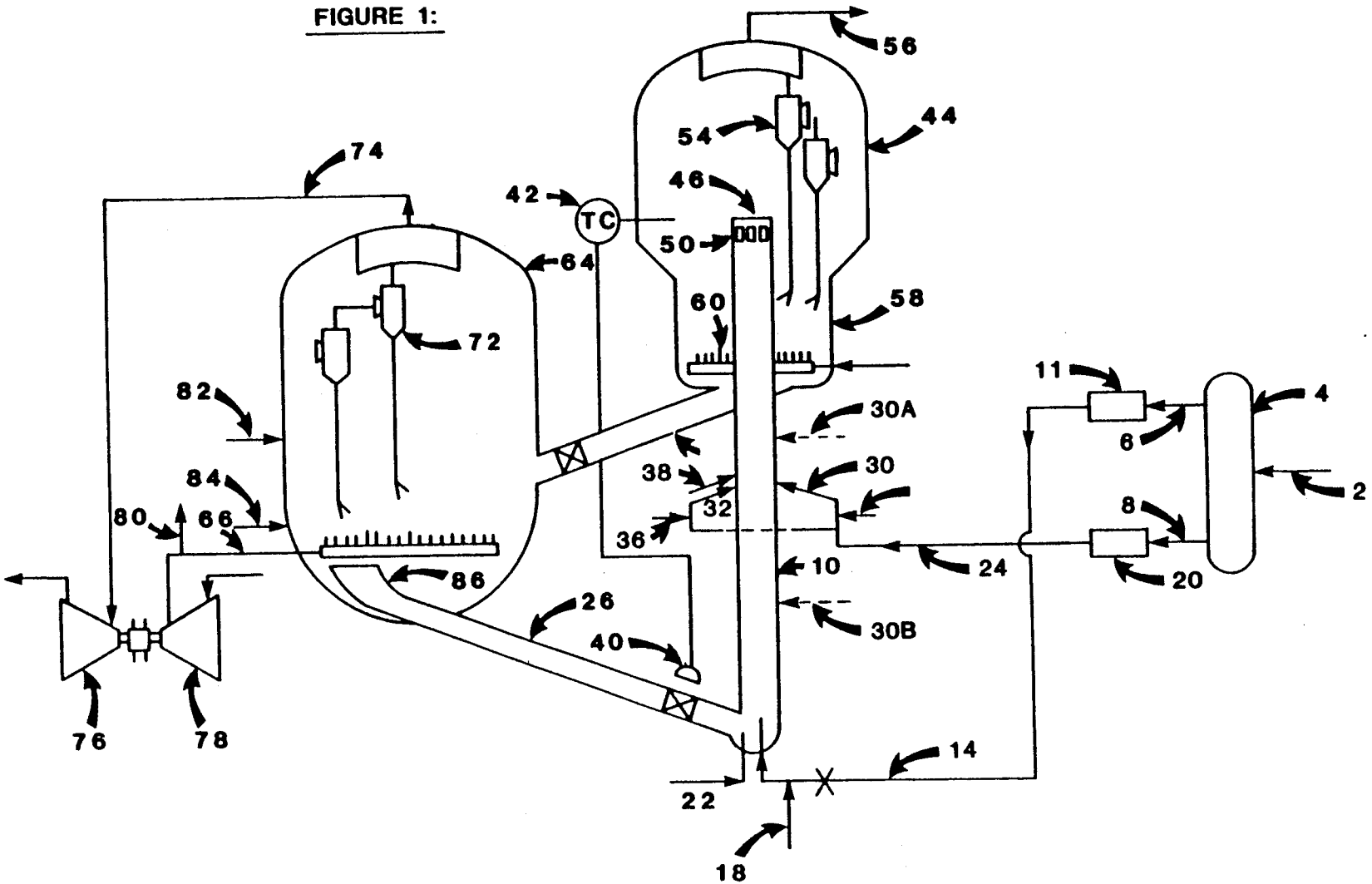

The invention relates generally to catalytic cracking of hydrocarbons. In one aspect, the invention relates to a temporary reduction of the activity of the catalyst, thereby creating an advantageous increase in yield and quality of light catalytic gas oil, and the octane number of the gasoline. Particularly, the invention relates to selective alteration in the yield distribution from catalytic cracking toward more middle distillate and less light distillate. Specifically, the middle distillate (light catalytic gas oil) has a higher cetane number and the light distillate (gasoline) has a higher research octane number compared to conventional operation.

BACKGROUND OF INVENTION

Feedstocks containing higher molecular weight hydrocarbons are cracked by contacting the feedstocks under elevated temperatures with a cracking catalyst whereby light and middle distillates are produced. Typically, the yield ratio of light distillate (gasoline) to middle distillate (light catalytic gas oil) is dependent upon the conversion level, therefore to increase the make of middle distillate, a corresponding decrease in conversion must be experienced. Unfortunately, this decrease in conversion requires significant changes in operating conditions which can have a detrimental impact on gasoline octane quality, or a change in catalyst type which can be time consuming and costly. Furthermore, presently available techniques for lowering the conversion level in a cracking operation result in poor selectivity to the desired middle distillate product, and instead, lead to high yields of undesirable heavy, 650° F.+ slurry oils. Therefore, with the current increase in demand for middle distillate fuels, it is desirable to have a modified cracking process available for quickly and reversibly changing from a maximum gasoline mode of operation to a maximum middle distillate mode of operation without lowering the octane number of the gasoline, to meet both seasonal and longer term fluctuations in the demand for distillate products.

SUMMARY OF INVENTION

It is thus one object of this invention to provide a regenerated cracking process.

A further object of this invention is to provide a process for reversibly modifying the activity of the cracking catalyst.

Another object of this invention is to shift the yield distribution associated with a cracking process toward middle distillate.

A still further object of this invention is to provide a process for improving the cetane quality of the middle distillate (light catalytic gas oil) and the octane quality of the light distillate (gasoline).

Yet another object of this invention is to provide a process for switching from a maximum gasoline mode to a maximum distillate mode of operation, and back again to a maximum gasoline mode in a quick and reversible manner.

Further objects, embodiments, advantages and features of this invention will become apparent to those skilled in the art from the following description and appended claims.

In accordance with this invention, we have found that a desirable way to advantageously shift the yield distribution toward more middle distillate is to contact the cracking catalyst with a basic nitrogen compound, preferably an organic nitrogen compound or ammonia. The present invention also provides methods for unexpectedly upgrading the quality of the gasoline produced in the process. In this connection a surprising result is thereby evident from our invention, as the gasoline produced from conventional maximum distillate operations is usually lower in octane compared to maximum gasoline modes of operation.

Present and forecasted future trends in the petroleum industry indicate significant changes in the demand patterns for petroleum products. The demand for gasoline has declined considerably, and is expected to decline further in the future. On the other hand, the demand for middle distillate products is on the rise. The fluid catalytic cracking process was developed to meet growing demand for gasoline in the 1930's and 1940's, and has traditionally been a process for maximizing the yield of gasoline from petroleum derived charge stocks. With the changes in demand trends described above, the present invention contemplates a new mode of operation of the fluid catalytic cracking process to advantageously shift yields to meet product demand changes.

Our invention, therefore, contemplates cracking of charge stocks by contacting with a catalyst that has been treated with a basic nitrogen compound, to increase the yield of middle distillate. In this connection, we have discovered that the gasoline produced in the process of this invention is unexpectedly upgraded from lower octane gasoline constituents to constituents having a significantly higher octane rating.

It is well known, of course, that the operating severity in a fluid catalytic cracking process can be lowered, for example, by lowering the temperature of operation, or lowering catalyst to oil ratio (by raising feed preheat temperatures) to increase the yield of middle distillate. The process, however, heretofore, has been generally unrewarding because the gasoline produced from the process is lower in octane number, and the selectivity to middle distillate vis-a-vis heavy slurry oil is poor. Similarly, it is also well known that cracking catalysts can be manufactured with a wide range of activities, and that lower activity catalysts can be employed in the cracking process to reduce conversion and increase the yield of middle distillate. However, such a process also suffers from poor selectivity to the desired product and from loss in product quality. In addition, changing catalyst in a commercial fluid catalytic cracking unit may take several weeks to accomplish and thus a poor method for responding to quick, seasonal changes in product demand shifts.

It has been known, prior to this invention, that basic nitrogen compounds poison the activity of cracking catalysts [Voge et al., "Catalytic Cracking of Pure Compounds and Petroleum Fractions," Proceedings of the Third World Petroleum Congress, Section IV, pages 124–137; Mills et al., "Chemical Characterization of Catalysts. I. Poisoning of Cracking Catalysts by Nitrogen Compounds and Potassium Ion," Journal of American Chemical Society (1950), 72, pages 1554–1560]. In point of fact, feeding of charge stocks containing even moderate levels of basic nitrogen compounds has been carefully avoided in the past whenever possible. Although our present invention takes advantage of the fact that basic nitrogen compounds can lower catalytic activity, no catalytic cracking process is known to us that advantageously employs these basic nitrogen compounds, recognizing the temporary nature of the catalyst poisoning effect, in the absence of added hydrogen, to obtain the desired reversible shifts in the yields of products while simultaneously improving product quality.

It is an object of this invention to utilize the poisoning effect of basic nitrogen compounds to gain flexibility to switch quickly from maximum gasoline mode to maximum middle distillate mode of operation in cracking units, without losing gasoline octane. In the invention, controlled amounts of the additive can be mixed with the feed or injected into the unit, to lower the conversion and increase middle distillate yields. The amount of the additive to be used will depend on the type of compound used, the extent of the middle distillate/light distillate shift required, unit limitations and $NO_x$ emission constraints. A suitable reactor-regenerator system for performing this invention is described in reference to FIG. 1. The cracking occurs with a fluidized zeolitic catalyst in an elongated reactor tube 10, which is referred to as a riser. The riser has a length to diameter ratio of above 20, or above 25. Hydrocarbon oil feed in line 2 to be cracked can be charged directly into the bottom of the riser through inlet line 14 or it can be first fractionated in column 4 into a relatively low molecular weight fraction which flows through line 6 and a relatively high molecular weight fraction which flows through line 8. The low molecular weight fraction is passed through preheater 11 to heat it to about 600° F. and then charged into the bottom of the riser through inlet line 14. Steam is introduced into the low molecular weight oil inlet line through line 18. Steam is also introduced independently to the bottom of the riser through line 22 to help carry upwardly into the riser regenerated catalyst which flows to the bottom of the riser through transfer line 26.

The high molecular weight hydrocarbon fraction is preheated to a temperature of about 600° F. in preheater 20 and is introduced through line 24 into the upper section of the riser at the zone wherein the diameter of the riser becomes enlarged. The high molecular weight hydrocarbon charge is introduced at about a 45 degree upward angle into the riser through lines 30 and 32. Steam can be introduced into the high molecular weight hydrocarbon inlet lines through lines 34 and 36. High molecular weight hydrocarbon lines 30 and 32 each represent a plurality of similar lines spaced circumferentially at the same height of the riser. Any recycle hydrocarbon can be admitted to the upper section of the riser through one of the upwardly inclined inlet lines designated as 38. Catalyst is added directly to the upper section of a riser or all of the catalyst can be added at the bottom of the riser together with the low molecular weight hydrocarbon feed. The residence times of both the high molecular weight feed and the low molecular weight feed can be varied by varying either the relative amounts or positions of introduction of the high and low molecular weight feed streams. Therefore, the high molecular weight feed stream can be introduced, through line 30, or alternately through higher or lower lines 30A or 30B, respectively.

The feed additive, basic nitrogen compounds, preferably organic nitrogen compounds, as liquid or gas, can be introduced into the unit in one of several ways or any combination thereof. As liquid, it can be admixed with the charge stock in tank storage, or introduced into the hydrocarbon oil feed in line 2 or into the low molecular weight fraction in line 14, the high molecular weight fraction in lines 24 or 30C, the recycle hydrocarbon stream in line 18, into the reactor vessel in line 30D or injected into the regenerated catalyst transfer line 26. As a gas (say, ammonia), the additive can be introduced into the catalyst transfer line 26, along with or in place of steam in lines 18 and 22. The preferred mode of introduction of the feed additive is such that the catalyst is contacted by the additive and some of the acid-sites on the catalyst titrated and made inactive prior to contact with the hydrocarbon feed. It is also noted that for maximum chemisorption of the basic compound onto the catalyst, temperatures lower than 1000° F., preferably lower than 930° F. are favored.

The full range oil charge to be cracked in the riser is a gas oil having a boiling range of about 430° F. to 1100° F. The feedstock to be cracked can also include appreciable amounts of virgin or hydrotreated residua having a boiling range of 900° F. to 1500° F. As indicated above, before being charged the gas oil can be fractionated into a low molecular weight fraction which is charged to the bottom of the riser and a high molecular weight fraction which is charged to the top of the riser. The steam added to the riser amounts to about 10 weight percent based on the oil charge, but the amount of steam can vary widely. The steam is added with both the low and high molecular weight hydrocarbon fractions. The catalyst employed is a fluidized zeolitic aluminosilicate and is added to the bottom only of the riser. The riser temperature range is about 900° F. to 1100° F. and is controlled by measuring the temperature of the product from the risers and then adjusting the opening of valve 40 by means of temperature controller 42 which regulates the inflow of hot regenerated catalyst to the bottom of the riser. The temperature of the regenerated catalyst is above the control temperature in the riser so that the incoming catalyst contributes heat to the cracking reaction. The riser pressure is between about 10 and 35 psig. Between about 0 and 5 percent of the oil charge to the riser is normally recycled.

The residence time of both hydrocarbon and catalyst in the riser is very small and ranges from 0.5 to 5 seconds. The lower molecular weight hydrocarbon is usually in the riser for about two seconds because it is introduced to the bottom of the riser but the higher molecular weight hydrocarbon will generally be in the riser for no more than about one second because it is introduced into the top of the riser. The velocity throughout the riser is about 35 to 55 feet per second and is sufficiently high so that there is little or no slippage between the hydrocarbon and catalyst flowing through the riser. Therefore, no bed of catalyst is permitted to build up within the riser, whereby the density within the riser is very low. The density within the riser is a maximum of about 4 pounds per cubic foot at the bottom of the riser and decreases to about 2 pounds per cubic foot at the top of the riser. Since no dense bed of catalyst is permitted to build up within the riser, the space velocity through the riser is usually high and will have a range between 100 or 120 and 600 weight of hydrocarbon per hour per instantaneous weight of catalyst in the reactor. No significant catalyst buildup within the reactor is permitted to occur, and the instantaneous catalyst inventory within the riser is due to a flowing catalyst to oil weight ratio between about 4:1 and 15:1, the weight ratio corresponding to the feed ratio.

The hydrocarbon and catalyst exiting from the top of each riser is passed into a disengaging vessel 44. The top of the riser is capped at 46 so that discharge occurs through lateral slots 50 for proper dispersion. An instantaneous separation between hydrocarbon and catalyst occurs in the disengaging vessel. The hydrocarbon which separates from the catalyst is primarily gasoline together with some heavier components and some lighter gaseous components. The hydrocarbon effluent passes through cyclone system 54 to separate catalyst fines contained therein and is discharged to a fractionator through line 56. The catalyst separated from hydrocarbon in disengager 44 immediately drops below the outlets of the riser so that there is no catalyst level in the disengager, but only in a lower stripper section 58. Steam is introduced into catalyst stripper section 58 through sparger 60 to remove any entrained hydrocarbon in the catalyst.

Catalyst leaving stripper 58 passes through transfer line 62 to a regenerator 64. This catalyst contains carbon deposits which tend to lower its cracking activity and as much carbon as possible must be burned from the surface of the catalyst. The burning is accomplished by introduction to the regenerator through line 66 of approximately the stoichiometrically required amount of air for combustion of the carbon deposits. The catalyst from the stripper enters the bottom section of the regenerator in a radial and downward direction through transfer line 62. Flue gas leaving the dense catalyst bed in regenerator 64 flows through cyclones 72 wherein catalyst fines are separated from flue gas permitting the flue gas to leave the regenerator through line 74 and pass through a turbine 76 before leaving for a waste heat boiler wherein any carbon monoxide contained in the flue gas is burned to carbon dioxide to accomplish heat recovery. Turbine 76 compresses atmospheric air in air compressor 78 and this air is charged to the bottom of the regenerator through line 66.

The temperature throughout the dense catalyst bed in the regenerator is about 1250° F. The temperature of the flue gas leaving the top of the catalyst bed in the regenerator can rise due to afterburning of carbon monoxide to carbon dioxide. Approximately a stoichiometric amount of oxygen is charged to the regenerator and the reason for this is to minimize afterburning of carbon monoxide to carbon dioxide above the catalyst bed to avoid injury to the equipment, since at the temperature of the regenerator flue gas, some afterburning does occur. In order to prevent excessively high temperatures in the regenerator flue gas due to afterburning, the temperature of the regenerator flue gas is controlled by measuring the temperature of the flue gas entering the cyclones and then venting some of the pressurized air otherwise destined to be charged to the bottom of the regenerator through vent line 80 in response to this measurement. Alternatively, CO oxidation promoters can be employed, as is well known in the art, to oxidize the CO completely to $CO_2$ in the regenerator dense bed, thereby eliminating any problems due to afterburning in the dilute phase. With complete CO combustion, regenerator temperatures can be in excess of 1250° F., up to 1500° F. The regenerator reduces the carbon content of the catalyst from 1.0 weight percent to 0.2 weight percent, or less. If required, steam is available through line 82 for cooling the regenerator. Makeup catalyst is added to the bottom of the regenerator through line 84. Hopper 86 is disposed at the bottom of the regenerator for receiving regenerated catalyst to be passed to the bottom of the reactor riser through transfer line 26.

The additive of this invention is selected from the group consisting of basic, nitrogen-containing compounds and mixtures thereof. Classes of suitable nitrogen-containing compounds include aliphatic and aromatic amines as well as compounds including other heteroatoms in addition to nitrogen. The compounds may contain primary, secondary or tertiary-substituted nitrogen atoms. A desirable attribute of the nitrogen compounds for application as additives in the process of the present invention is the presence of one or more lone pairs of electrons. The presence of nitrogen-hydrogen bonds in the compounds is not prohibitive, but it is recognized that such bonds reduce the effectiveness of the compounds for use as additives in the process. Suitable additives include but are not restricted to ammonia, monoalkyl, dialkyl and trialkyl amines both of linear and cyclic types, alkonolamines, aromatic amines such as pyridine, quinoline, aniline, pyrrole and alkyl derivatives thereof, pyrimidine, quinoxaline, quinazoline, pyrazine and alkyl derivatives thereof, as well as high nitrogen extracts from petroleum, shale and coal derived oils. Preferred compounds are aromatic amines and ammonia.

The concentration of the additive in the feed will vary depending on the basicity of the additive, and whether the additive is in liquid or gaseous form under the conditions employed. The concentration of the liquid additive should be in the range of 0.01 weight percent to 10.0 weight percent of feed, more preferably in the range between 0.10 weight percent and 1.0 weight percent of feed. If a gaseous additive such as ammonia is employed, the concentration should preferably be in the range of 0.1 to 15.0 weight percent of feed, more preferably in the range of 1.0 to 10.0 weight percent of feed.

EXAMPLES

To demonstrate the efficacy of our invention in increasing the yield of middle distillate while simultaneously upgrading the quality of the light and middle distillate products, we have run a number of tests on a microactivity unit and a circulating FCC pilot plant using feedstocks and catalyst described in Tables I and II, respectively, and a variety of basic nitrogen compounds. Each fresh catalyst was heat shocked at 1100° F. for one hour, followed by calcination at 1000° F. for 10 hours and a steam treatment at 1350° F. with about 100 percent steam for at least 10 hours. The equilibrium samples of catalysts used were obtained from various commercial fluid catalytic cracking units.

EXAMPLE I

Figure 2:
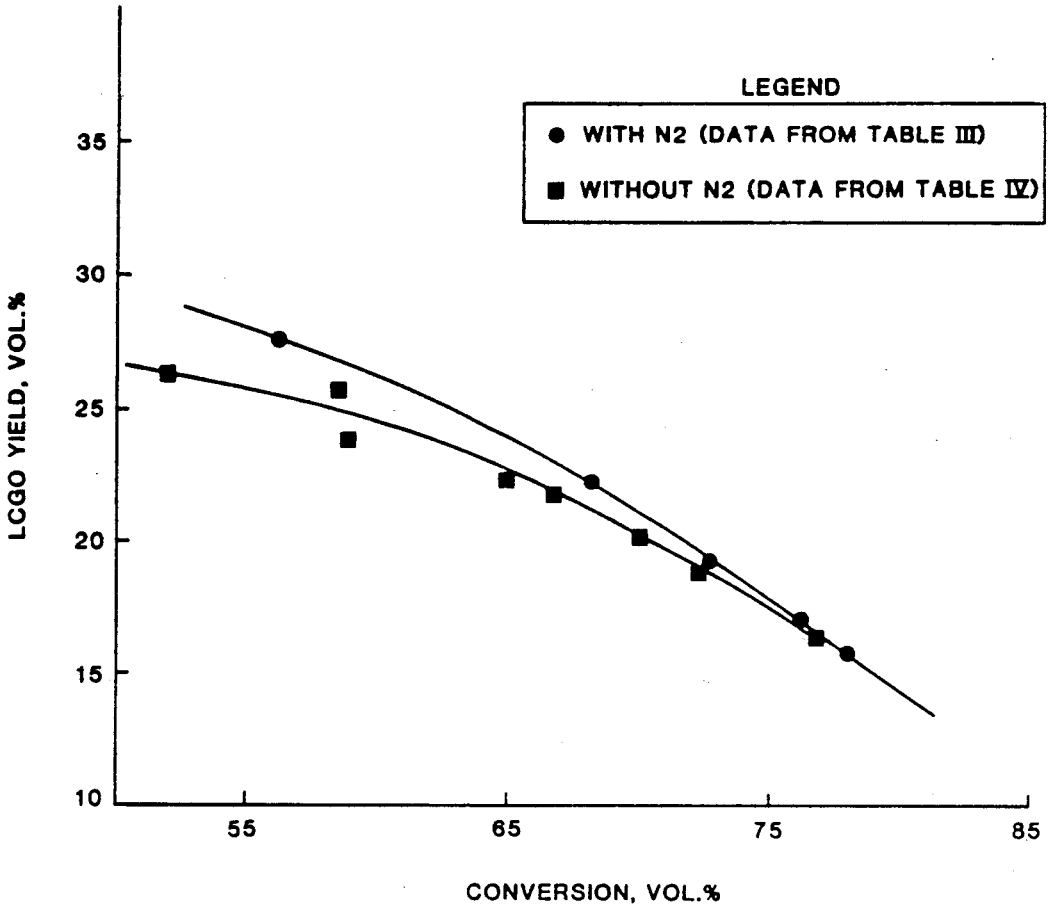

Table III, which follows, shows the effects of contacting a cracking catalyst with various basic nitrogen compounds on yield distribution in a Microactivity test unit. Compared to the untreated catalyst (Run 1), the treated catalysts (Runs 2 through 6) provide significant increases in the light catalytic gas oil/gasoline yield ratio. Similar microactivity tests were also used to test a variety of steam deactivated commercial cracking catalysts with a wide range of activities which were not treated with nitrogen compounds according to the teachings of the present invention. The data from these tests are shown in Table IV and indicate that the use of lower activity catalysts would be a viable way to increase middle distillate yields (Runs 7 through 13). However, as shown in FIG. 2, at equivalent conversion, the use of basic nitrogen compounds is a superior way to increase middle distillate compared to using lower activity catalysts because the selectivity to the desired product is better. In other words, at the same conversion, the catalyst treated with basic nitrogen compounds provides a higher yield of the desirable light catalytic gas oil product and a lower yield of the undesirable lower value slurry oil compared to the untreated catalysts. Of course, the flexibility gained from being able to adjust the yield distribution from the cracking process readily and quickly without going through the cumbersome procedure of changing catalysts is evident from this comparison

TABLE I

| | CHARGESTOCK INSPECTIONS | | | |
|---|---|---|---|---|
| Chargestock | Gas Oil 1 | Gas Oil 2 | Gas Oil 3 | Gas Oil 4 |
| Gravity: °API | 26.1 | 27.3 | 27.9 | 26.9 |

TABLE I-continued

| | CHARGESTOCK INSPECTIONS | | | |
|---|---|---|---|---|
| Chargestock | Gas Oil 1 | Gas Oil 2 | Gas Oil 3 | Gas Oil 4 |
| Nickel, ppm | 0.3 | 0.4 | 0.3 | 0.2 |
| Vanadium, ppm | 0.4 | 0.1 | 0.3 | 0.9 |
| Vacuum Distillation, °F. | | | | |
| 10% at 760 MM | 575 | 550 | 595 | 622 |
| 30% | 672 | 669 | 685 | 695 |
| 50% | 745 | 751 | 765 | 770 |
| 70% | 809 | 832 | 845 | 851 |
| 90% | 911 | 972 | 934 | 953 |
| Hydrocarbon Type | | | | |
| Aromatics | 36.9 | 31.9 | 32.2 | — |
| Mono | 16.7 | 13.5 | 11.8 | — |
| Di | 15.4 | 12.4 | 10.9 | — |
| Tri+ | 4.8 | 6.0 | 9.5 | — |
| Saturates | 58.6 | 58.8 | 61.7 | — |
| Polar Compounds | 4.5 | 2.3 | 0.8 | — |
| Volatiles | — | 7.0 | 5.3 | — |

TABLE II

| | CATALYST INSPECTIONS | | | | |
|---|---|---|---|---|---|
| Catalyst Description | Catalyst 1 (Equilibrium) | Catalyst 2 (Equilibrium) | Catalyst 3 (Equilibrium) | Catalyst 4 (Equilibrium) | Catalyst 5 (Equilibrium) |
| Activity (Microactivity Test) | 63.9 | 59.3 | 72.7 | 78.0 | 64.7 |
| Physical Characteristics | | | | | |
| Surface Area: $m^2/g$ | 141.0 | 104.8 | 145.4 | 265.0 | 139.0 |
| Pore Volume: cc/g | 0.201 | 0.21 | 0.154 | 0.22 | 0.26 |
| Pore Diameter: A | 57.0 | 80.1 | — | — | — |
| Apparent Bulk Density: g/cc | 0.812 | 0.829 | 0.844 | 0.89 | 0.776 |
| Particle Size Distribution: wt % | | | | | |
| <20 microns | 2.6 | 2.2 | 1.7 | 0.1 | 0.7 |
| 20–40 microns | 7.0 | 2.3 | 10.4 | 7.1 | 9.5 |
| 40–80 microns | 58.0 | 56.3 | 57.3 | 37.9 | 54.7 |
| >80 microns | 32.4 | 39.2 | 30.6 | 54.9 | 35.1 |
| Two-Hour Attrition Index | 6.2 | 9.2 | 4.4 | 2.7 | — |
| Chemical Composition: wt % | | | | | |
| Carbon | 0.29 | 0.20 | 0.12 | — | 0.17 |
| Iron ($Fe_2O_3$) | 0.515 | 1.10 | 0.83 | 0.46 | 0.186 |
| Nickel (Ni) | 0.050 | 0.017 | 0.024 | — | 0.027 |
| Vanadium (V) | 0.120 | 0.049 | 0.027 | — | 0.012 |
| Sodium (Na) | 0.45 | 0.42 | 0.41 | 0.27 | 0.32 |
| Alumina ($Al_2O_3$) | 29.48 | 37.61 | 45.0 | 50.1 | 34.02 |
| Cerium (Ce) | 0.88 | 0.43 | 0.74 | 0.37 | 0.42 |
| Lanthanum (La) | 1.39 | 0.52 | 1.01 | 1.17 | 1.90 |
| Titanium (Ti) | 0.57 | 0.51 | 0.41 | 2.12 | 0.16 |

TABLE III

| | EFFECT OF TREATING CATALYST WITH $N_2$ COMPOUNDS; MICROACTIVITY TEST DATA | | | | | |
|---|---|---|---|---|---|---|
| | Run 1 | Run 2 | Run 3 | Run 4 | Run 5 | Run 6 |
| Chargestock | Gas Oil 3 | | | | | |
| Catalyst | Catalyst 4 | | | | | |
| Additive Type | None | $N_2$ as Pyridine | $N_2$ as Pyridine | $N_2$ as Pyrrole | $N_2$ as Quinoline | $N_2$ as Diethanolamine |
| Additive Concentration, ppm | 0 | 500 | 2500 | | | |
| Conversion, vol % | 78.0 | 76.2 | 68.2 | 72.6 | 56.2 | 74.6 |
| Gasoline, vol % | 61.7 | 60.8 | 55.6 | 59.3 | 46.0 | 60.3 |
| Light Catalytic Gas Oil, vol % | 15.8 | 17.0 | 22.2 | 19.3 | 27.5 | 18.5 |
| Slurry Oil, vol % | 6.2 | 6.9 | 9.3 | 8.1 | 16.3 | 6.9 |

| | | | | |
|---|---|---|---|---|
| Sulfur, wt % | 0.24 | 0.20 | 0.59 | 0.47 |
| Nitrogen, wt % | 0.089 | 0.11 | 0.0946 | 0.063 |
| Carbon Residue, wt % | 0.64 | 0.33 | 0.33 | 0.26 |
| Aniline Point, °F. | 182.3 | 189.0 | — | 190.0 |
| Hydrogen, wt % | — | 12.74 | 12.72 | — |
| Viscosity, SUS, 210° F. | 40.5 | 40.6 | 40.9 | 41.7 |
| Pour Point, °F. | +95 | +85 | +100 | +90 |

TABLE IV

| MICROACTIVITY TEST DATA ON VARIOUS STEAM DEACTIVATED FRESH CRACKING CATALYSTS | | |
|---|---|---|
| Run No. | Conversion, vol % | Light Catalytic Gas Oil, vol % |
| 7 | 76.9 | 16.3 |
| 8 | 66.7 | 21.7 |
| 9 | 70.0 | 20.2 |

TABLE IV-continued

MICROACTIVITY TEST DATA ON VARIOUS STEAM DEACTIVATED FRESH CRACKING CATALYSTS

| Run No. | Conversion, vol % | Light Catalytic Gas Oil, vol % |
|---|---|---|
| 10 | 65.0 | 22.3 |
| 11 | 52.0 | 26.3 |
| 12 | 58.5 | 25.6 |
| 13 | 72.4 | 18.9 |
| 14 | 58.9 | 23.7 |

EXAMPLE II

In this example, a cracking catalyst was treated with ammonia for 5 minutes at 1250° F. before being evaluated in the microactivity test unit. As shown in Table V, the desired shift in yield distribution toward higher yield of middle distillate is evident when comparing yields from untreated catalyst (Run 15a) and treated catalyst (Run 15b).

EXAMPLE III

Tables VI and VII present data from a series of pilot plant runs that were performed to generate information on the methods available for increasing middle distillate yield prior to this invention, or purposes of comparison. The effect of lowering operating temperature on yield and product quality is shown in Table VI. The desired shift in yield toward more middle distillate material is achieved, but only at the expense of gasoline octane (Runs 16 through 19). The effect of catalyst/oil ratio (feed preheat temperature) is shown in Table VII: again, significant reductions in gasoline octane are seen when middle distillate maximization is achieved (Runs 20 through 22).

We overcome these disadvantages of the prior art and accomplish the desired results by providing a fluidized cracking process wherein the catalyst is treated with a basic nitrogen compound In the following example, quinoline was used as the basic nitrogen compound and was added to the feed to achieve the desired nitrogen concentrations shown in Table VIII. Compared to the performance of the untreated catalyst (Run 23), the data from Runs 24 and 25 show how the desired shift in yield distribution toward middle distillate is achieved, to varying degrees depending on the concentration of the nitrogen additive, while simultaneously improving the research octane number of the gasoline and the cetane number of the light catalytic gas oil. In addition, the data from Run 26 highlight another significant feature of this invention: for this run, the feed was quickly switched from one containing 2000 ppm nitrogen as quinoline to one that contained no added nitrogen. Within a few hours after the switch was made, the pilot plant operation stabilized and the yield distribution returned to that matching the maximum gasoline operation. Comparing the data from Run 26 with that from Run 23 indicates that the yields are the same within the range of accuracy and operating conditions control achievable in the pilot plant. The total time elapsed between the operation that yielded the results shown for Run 25 and that which yielded results shown for Run 26 was less than 4 hours, illustrating the ease and readiness with which operating modes can be changed with the process of this invention.

TABLE V

EFFECT OF TREATING CATALYST WITH AMMONIA: MICROACTIVITY TEST DATA

| | Run 15a | Run 15b |
|---|---|---|
| Chargestock | | |
| Catalyst | Catalyst 5 | |
| Treatment with Ammonia | No | Yes |
| Conversion, vol % | 71.6 | 66.6 |
| Gasoline, vol % | 55.9 | 53.9 |
| Light Gasoline Gas Oil, vol % | 19.1 | 21.6 |
| Slurry Oil, vol % | 9.2 | 11.9 |

TABLE VI

EFFECT OF RISER OUTLET TEMPERATURE ON LCGO YIELD: PILOT PLANT DATA

| | Run 16 | Run 17 | Run 18 | Run 19 |
|---|---|---|---|---|
| Chargestock | | Gas Oil 1 | | |
| Catalyst | | Catalyst | | |
| Operating Conditions | | | | |
| Riser Outlet Temp.: °F. | 1005 | 982 | 955 | 930 |
| Riser Inlet Temp.: °F. | | 1200 | | |
| Feed Preheat Temp.: °F. | | 520 | | |
| Catalyst/Oil Ratio | 9.8 | 8.8 | 8.3 | 6.6 |
| Conversion: vol % FF | | | | |
| Product Yields: vol % FF | 79.7 | 77.4 | 73.1 | 65.5 |
| Total $C_3$'s | 12.5 | 10.7 | 8.9 | 6.8 |
| $C_3$= | 10.2 | 9.0 | 7.4 | 5.7 |
| Total $C_4$'s | 20.6 | 18.4 | 15.8 | 13.3 |
| $iC_4$ | 7.2 | 6.3 | 5.7 | 4.7 |
| $C_4$= | 11.8 | 10.8 | 9.1 | 7.7 |
| $C_5$− 430° F. TBP Gasoline | 59.3 | 61.2 | 60.6 | 56.4 |
| 430–650° F. TBP Light Catalytic Gas Oil | 16.2 | 17.4 | 20.4 | 25.0 |
| 650+ °F. TBP Slurry Oil | 4.1 | 5.2 | 6.5 | 9.5 |
| Total $C_3$+ Liquid | 112.7 | 112.9 | 112.2 | 111.0 |
| Gas Yields: wt % FF | | | | |
| $C_2$ and Lighter | 2.9 | 2.2 | 1.8 | 1.4 |
| Hydrogen | 0.07 | 0.06 | 0.06 | 0.06 |
| Coke Yield: wt % FF | 4.9 | 4.1 | 3.6 | 3.1 |
| Gasoline Product Inspections | | | | |
| MON: Clear | 82.4 | 81.0 | 79.7 | 78.2 |
| RON: Clear | 93.8 | 92.2 | 90.5 | 89.3 |

TABLE VII

EFFECT OF CATALYST/OIL ON LIGHT CATALYTIC GAS OIL YIELD: PILOT PLANT DATA

| | Run 20 | Run 21 | Run 22 |
|---|---|---|---|
| Chargestock | | Gas Oil 2 | |
| Catalyst | | Catalyst 1 | |
| Operating Conditions: | | | |
| Riser Outlet Temp., °F. | | 1000 | |
| Catalyst/Oil Ratio | 6.7 | 7.9 | 9.1 |
| Regen. Catalyst Temp., °F. | | 1250 | |
| Feed Preheat Temp., °F. | 650 | 515 | 400 |
| Conversion: vol % FF | 76.7 | 79.4 | 81.4 |
| Product Yields: vol % FF | | | |
| Total $C_3$'s | 10.6 | 12.5 | 12.8 |
| $C_3$= | 9.1 | 10.0 | 10.3 |
| Total $C_4$'s | 19.3 | 20.5 | 20.7 |
| $iC_4$ | 6.7 | 8.5 | 7.8 |
| $C_4$= | 11.3 | 10.1 | 10.8 |
| $C_5$+ Gasoline | 58.9 | 59.3 | 60.5 |
| Light Catalytic Gas Oil | 16.5 | 14.4 | 13.3 |
| Slurry Oil | 6.8 | 6.2 | 5.3 |
| $C_3$+ Liquid Recovery | 112.2 | 112.9 | 112.6 |
| Gas Yield: wt % FF $C_2$+ and Lighter | 2.3 | 2.5 | 2.5 |
| Coke Yield: wt % FF | 4.2 | 4.6 | 5.4 |
| Full Range Gasoline Octanes: | | | |
| MON, Cl | 79.5 | 80.0 | 79.8 |
| RON, Cl | 91.0 | 91.3 | 91.7 |

TABLE VIII

EFFECT OF NITROGEN ADDED TO FEED ON FCC PERFORMANCE: PILOT PLANT DATA

| | Run 23 | Run 24 | Run 25 | Run 26 |
|---|---|---|---|---|
| Chargestock | | Gas Oil 3 | | |
| Catalyst | | Catalyst 3 | | |
| Nitrogen Added as Quinoline in feed, ppm | 0 | 1000 | 2000 | 0 |
| Operating Conditions: | | | | |
| Riser Outlet Temp.: °F. | 983 | 980 | 981 | 980 |
| Riser Inlet Temp.: °F. | | 1200 | | |
| Feed Preheat Temp.: °F. | | 520 | | |
| Catalyst/Oil Ratio | | ~9.0 | | |
| Conversion: vol % FF | 78.5 | 70.9 | 68.2 | 77.9 |
| Product Yields: vol % FF | | | | |
| Total $C_3$'s | 11.6 | 9.9 | 9.2 | 11.8 |
| $C_3$= | 9.5 | 8.2 | 7.5 | 9.7 |
| Total $C_4$'s | 18.6 | 15.1 | 14.1 | 18.5 |
| $iC_4$ | 6.5 | 4.3 | 3.6 | 6.3 |
| $C_4$= | 10.5 | 9.6 | 9.4 | 10.7 |
| $C_5$− 430° F. TBP Gasoline | 59.9 | 55.4 | 52.7 | 59.7 |
| 430–650° F. TBP Light Catalytic Gas Oil | 13.8 | 17.9 | 20.2 | 14.9 |
| 650+ °F. TBP Slurry Oil | 7.7 | 11.2 | 11.7 | 7.2 |
| Total $C_3$+ Liquid | 111.6 | 109.5 | 107.8 | 112.0 |
| Gas Yield: wt % FF | | | | |
| $C_2$+ and Lighter | | | | |
| Coke Yield: wt % FF | 4.2 | 3.9 | 4.0 | 4.2 |
| Gasoline Product Inspections | | | | |
| MON, Clear | 79.2 | 79.8 | 79.4 | — |
| RON, Clear | 91.1 | 91.4 | 91.8 | — |
| Light Catalytic Gas Oil Cetane Number | 24.4 | 30.3 | 31.4 | — |

EXAMPLE IV

In another embodiment of this invention, it is contemplated that high nitrogen oils derived from shale liquids could be advantageously employed as additives. The following table, Table IX, shows pilot plant data from a series of runs involving admixture of a high nitrogen-containing shale oil with conventional gas oil cracking charge stock. The data demonstrate that the desired yield shifts and product quality improvements associated with the process of the present invention are evident when employing the shale oil derived additive (Runs 27 though 29.)

TABLE IX

EFFECT OF BLENDING SHALE OIL WITH CRACKING STOCK

| | Run 27 | Run 28 | Run 29 |
|---|---|---|---|
| Chargestock | Gas Oil 5 | Gas Oil 5 + Shale Oil | |
| Catalyst | | Catalyst 5 | |
| $N_2$ Content of Chargestock, ppm | 630 | 2900 | 6100 |
| Operating Conditions: | | | |
| Riser Outlet Temp., °F. | | 980 | |
| Catalyst/Oil Ratio | | 11.5 | |
| Regen. Cat. Temp.: °F. | | 1227 | |
| Feed Preheat Temp.: °F. | | 520 | |

TABLE IX-continued

EFFECT OF BLENDING SHALE OIL WITH CRACKING STOCK

| | Run 27 | Run 28 | Run 29 |
|---|---|---|---|
| Conversion: vol % FF | 83.6 | 78.2 | 70.4 |
| Product Yields: vol % FF | | | |
| Total $C_3$'s | 14.2 | 11.7 | 10.5 |
| $C_3$= | 11.3 | 9.4 | 7.9 |
| Total $C_4$'s | 22.1 | 18.2 | 13.3 |
| $iC_4$ | 9.2 | 6.0 | 3.4 |
| $C_4$= | 10.6 | 10.6 | 8.8 |
| $C_5$+ Gasoline | 60.0 | 58.5 | 50.7 |
| Light Catalytic Gas Oil | 11.1 | 13.5 | 16.9 |
| Slurry Oil | 5.4 | 8.3 | 12.7 |
| $C_3$+ Liquid Recovery | 112.7 | 110.2 | 104.0 |
| Gas Yield: wt % FF | | | |
| $C_2$+ and Lighter | 2.9 | 3.0 | 3.7 |
| Coke Yield: wt % FF | 5.9 | 5.8 | 7.9 |
| Full Range Gasoline Octanes: | | | |
| MON, Cl | 81.4 | 79.8 | 80.3 |
| RON, Cl | 92.6 | 93.7 | 93.2 |

What is claimed is:

1. A process for the catalytic cracking of hydrocarbon oil feed which comprises contacting said feed under catalytic cracking conditions with a cracking catalyst in the presence of an additive comprising a basic nitrogen compound, to effect a shift in yield distribution from a maximum gasoline mode to a maximum middle distillate mode of operation.

2. The process of claim 1 wherein said additive is selected from the group consisting of linear and cyclic-type, monoalkyl, dialkyl and trialkyl amines, alkonolamines, aromatic amines, pyridine, quinoline, aniline, pyrrole, pyrimidine, quinoxaline, quinazoline, pyrazine and alkyl derivatives thereof.

3. The process of claim 1 wherein the said additive is a high nitrogen extract from a group consisting of petroleum, shale and coal derived oils.

4. The process of claim 2 wherein said additive concentration in the feed is in the range of 0.01 weight percent to 10.0 weight percent of feed.

5. The process of claim 1 wherein ammonia is said additive.

6. The process of claim 5 wherein the concentration of ammonia is in the range of 0.1 to 15.0 weight percent of feed.

7. The process of claim 1 wherein the said additive is introduced into the unit as a liquid by admixing with the charge stock in tank storage 8. The process of claim 1 wherein the said additive is introduced into the hydrocarbon oil feed line at various points along a riser, or into a reactor vessel, of a fluid catalytic cracking unit.

9. The process of claim 1 wherein the said additive is introduced with a recycle stream, or injected into a regenerated catalyst transfer line of a catalytic cracking unit.

10. The process of claim 1 wherein the said additive in the form of a gas is introduced into a catalytic cracking unit along with, or in place of, steam, through lines normally used to introduce steam into the unit.

* * * * *